US010019920B2

(12) United States Patent
Yang et al.

(10) Patent No.: US 10,019,920 B2
(45) Date of Patent: Jul. 10, 2018

(54) DISPLAY MODULE DETECTION DEVICE

(71) Applicants: Boe Technology Group Co., Ltd., Beijing (CN); Boe (Hebei) Mobile Display Technology Co., Ltd., Hebei (CN)

(72) Inventors: Guowen Yang, Beijing (CN); Baohong Zhu, Beijing (CN); Ze Zhang, Beijing (CN); Jian Li, Beijing (CN)

(73) Assignees: BOE TECHNOLOGY GROUP CO., LTD., Beijing (CN); BOE (HEBEI) MOBILE DISPLAY TECHNOLOGY CO., LTD., Hebei (CN)

( * ) Notice: Subject to any disclaimer, the term of this patent is extended or adjusted under 35 U.S.C. 154(b) by 9 days.

(21) Appl. No.: 15/124,629

(22) PCT Filed: Apr. 17, 2015

(86) PCT No.: PCT/CN2015/076871
§ 371 (c)(1),
(2) Date: Sep. 8, 2016

(87) PCT Pub. No.: WO2016/074441
PCT Pub. Date: May 19, 2016

(65) Prior Publication Data

US 2017/0018213 A1 Jan. 19, 2017

(30) Foreign Application Priority Data

Nov. 10, 2014 (CN) ..... 2014 1 0645332

(51) Int. Cl.
*G09G 3/00* (2006.01)
*G09G 5/00* (2006.01)

(52) U.S. Cl.
CPC ..... *G09G 3/006* (2013.01); *G09G 3/00* (2013.01); *G09G 5/006* (2013.01); *G09G 2330/02* (2013.01); *G09G 2360/02* (2013.01)

(58) Field of Classification Search
CPC ..... G09G 3/006
See application file for complete search history.

(56) References Cited

U.S. PATENT DOCUMENTS 5,546,098 A * 8/1996 Moriconi ..... G06F 1/1616 345/204
5,594,465 A * 1/1997 Poulachon ..... G06F 3/147 343/702

(Continued)

FOREIGN PATENT DOCUMENTS

CN 1677360 10/2005
CN 101368991 2/2009

(Continued)

OTHER PUBLICATIONS

Office Action from China Application No. 201410645332.5 dated Feb. 9, 2017.

(Continued)

*Primary Examiner* — Walter L Lindsay, Jr.
*Assistant Examiner* — Milton Gonzalez
(74) *Attorney, Agent, or Firm* — Calfee, Halter & Griswold LLP

(57) ABSTRACT

A display module detection device is disclosed. The display module detection device includes a storage module, in which configuration parameters of multiple types of display modules are pre-stored for determining a configuration parameter to be outputted by the storage module based on a type of a display module to be detected, and a test system module being communicatively connected with the storage module and configured for determining an output parameter (Continued)

of a test signal output interface based on the configuration parameter outputted by the storage module.

10 Claims, 1 Drawing Sheet

(56) References Cited

U.S. PATENT DOCUMENTS

| | | | | |
|---|---|---|---|---|
| 6,219,451 | B1 * | 4/2001 | Hunt | G09G 5/006 345/3.1 |
| 6,914,586 | B2 * | 7/2005 | Burkhardt | G09G 3/3611 345/100 |
| 2009/0303331 | A1 * | 12/2009 | Yoon | G09G 3/006 348/189 |
| 2012/0221282 | A1 * | 8/2012 | Chen | G06F 11/2284 702/117 |
| 2013/0226487 | A1 * | 8/2013 | Yang | G09G 3/2096 702/64 |
| 2016/0109934 | A1 * | 4/2016 | Woo | G06F 1/3293 345/211 |

FOREIGN PATENT DOCUMENTS

| | | |
|---|---|---|
| CN | 201382850 | 1/2010 |
| CN | 201489794 | 5/2010 |
| CN | 201837802 | 5/2011 |
| CN | 103178998 | 6/2013 |
| CN | 103414602 | 11/2013 |
| CN | 103777386 | 5/2014 |
| CN | 104318882 | 1/2015 |
| CN | 204288754 | 4/2015 |
| EP | 157028 | 10/1985 |

OTHER PUBLICATIONS

Office action from Chinese Application No. 201410645332.5 dated Nov. 4, 2015.

Office action from Chinese Application No. 201410645332.5 dated Jul. 5, 2016.

International Search Report and Written Opinion from PCT/CN15/76871 dated Jul. 22, 2015.

* cited by examiner

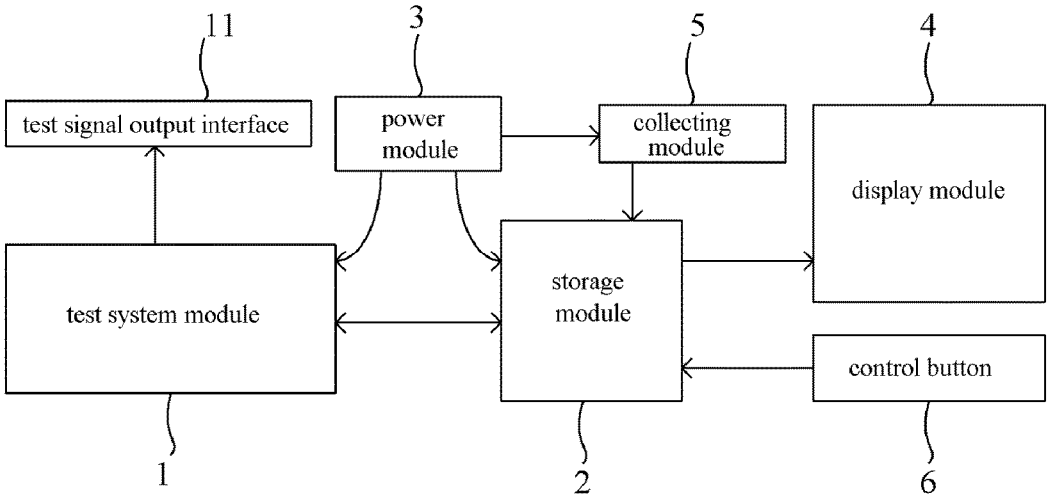
11
3
5
4
test signal output interface
power module
collecting module
display module
test system module
storage module
control button
1
2
6

DISPLAY MODULE DETECTION DEVICE

RELATED APPLICATIONS

The present application is the U.S. national phase entry of PCT/CN2015/076871, with an international filling date of Apr. 17, 2015, which claims the benefit of Chinese Patent Application No. 201410645332.5, filed on Nov. 10, 2014, the entire disclosure of which is incorporated herein by reference.

FIELD OF THE INVENTION

The present invention relates to the technical field of display module testing, and in particular to a display module detection device.

BACKGROUND

Nowadays, as people's pursuit for display effects becomes higher and higher, the resolution of a mobile phone screen is further promoted to bring people a smooth display effect, which benefits from the improvement of performances of a mobile phone processor. With users' increased requirement for an optimal user experience, a touch screen has become a fundamental configuration of a display module, in particular when applied to mobile terminals such as mobile phones. Moreover, as assembling processes such as full lamination, On cell and In cell are increasingly mature, a display screen and the touch screen are generally integrated together in a display module.

During the production of a display module, display screen detection and touch screen detection will necessarily be involved. Since there are numerous types of display screens and touch screens for a display module, different initialization codes and time sequence configurations are required to drive different types of display screens and touch screens due to differences in factors such as driving units, and/or the screens per se.

However, as for a detection device for detecting a display module in the prior art, each display module detection device is adapted to only one type of display screen and touch screen, which results in a poor applicability.

SUMMARY

Embodiments of the present invention provide a display module detection device capable of detecting multiple types of display modules with a high applicability.

To achieve the above objective, technical solutions will be provided as follows in the present disclosure.

A display module detection device comprises a storage module, in which configuration parameters of multiple types of display modules are pre-stored for determining a configuration parameter to be outputted by the storage module based on a type of a display module to be detected, and a test system module having a test signal output interface, the test system module being communicatively connected with the storage module and configured for determining an output parameter of the test signal output interface based on the configuration parameter outputted by the storage module.

As for the display module detection device, configuration parameters of multiple types of display modules are pre-stored in the storage module, the test system module may select suitable configuration parameters from the storage module based on types of the display screen and the touch screen in the detected display module, and then the test system module may configure the output parameters of the test signal output interface of the test system module in accordance with the configuration parameters in the storage module and matches the parameters of the test signal output interface of the test system module with the type of the detected display module, thereby performing display module detection for the display module of this type. The output parameters of the test signal output interface of the test system module comprise parameters related to driving the detected display module, e.g., parameters for the display screen and the touch screen in the detected display module such as initialization codes, driving time sequences and power up timing, etc.

In the display module detection device, the storage module may input a corresponding configuration parameter into the test system module based on different types of detected display modules, so as to adapt the display module detection device to multiple types of display modules without replacing a kernel of the test system module. Therefore, the display module detection device may perform detection for multiple types of display modules with a high applicability.

In addition, when the type of display module to be detected by the display module detection device is altered, it is unnecessary to recompile the kernel of the test system module or reinstall an image file of the test system module, but instead, what is needed is only to replace a program stored in the storage module, which makes the operation simple and convenient.

Preferably, the storage module comprises a single-chip microprocessor (SCM) module, the SCM module having a network interface, and the test system module is provided with a network interface, the network interface of the SCM module being communicatively connected with that of the test system module.

Preferably, the network interface of the SCM module being communicatively connected with that of the test system module comprises the SCM module being communicatively connected with the test system module via an Ethernet communication protocol.

Preferably, the SCM module comprises a control button.

Preferably, the display module detection device further comprises a power module, the power module being electrically connected with both the test system module and the SCM module.

Preferably, the power module is an integrated digital power source having multiple output paths of voltage, or the power module comprises a plurality of independent drive power sources having a controllable ON/OFF function.

Preferably, the test signal output interface comprised in the test system module comprises a synchronous serial communication bus interface, an inter-integrated circuit bus interface, a mobile industry processor interface, a color mode RGB signal interface, a central processing unit interface, a video graphics array interface and a power interface.

Preferably, the test system module comprises two signal connectors, one signal connector is provided with the synchronous serial communication bus interface, the inter-integrated circuit bus interface, the mobile industry processor interface, and the power interface, and the other signal connector is provided with the synchronous serial communication bus interface, the inter-integrated circuit bus interface, the color mode RGB signal interface, the central processing unit interface, the video graphics array interface and the power interface.

Preferably, the display module detection device further comprises a display unit, the display unit being in signal connection with the storage module.

Preferably, the display module detection device further comprises a collecting module for collecting voltage and current information at the power module when the display screen and a backlight of the display module are lighted up, the collecting module being in signal connection with the power module and the storage module.

BRIEF DESCRIPTION OF DRAWINGS

FIG. 1 is a block diagram for illustrating the principle of a display module detection device provided in an embodiment of the present invention.

DETAILED DESCRIPTION OF EMBODIMENTS

The technical solutions of the embodiments of the present invention shall be described clearly and fully with reference to the drawings for the embodiments. Apparently, the embodiments described below are only a part of the embodiments of the present invention, rather than all of them. All other embodiments obtained by a person having ordinary skills in the art based on these embodiments without inventive efforts shall fall within the scope of the present invention.

Referring to FIG. 1, which is a block diagram for illustrating the principle of a display module detection device provided by an embodiment of the invention.

The display module detection device provided by the embodiment of the invention comprises a storage module 2, in which configuration parameters of multiple types of display modules are pre-stored for determining a configuration parameter to be outputted by the storage module 2 based on a type of a display module to be detected; and a test system module 1 having a test signal output interface 11, the test system module 1 being communicatively connected with the storage module 2 and configured for determining an output parameter of the test signal output interface 11 based on the configuration parameter outputted by the storage module 2.

The configuration parameters of the display module may comprise, for example, initialization codes of the display screen and the touch screen in the display module, driving time sequences of interfaces such as MIPI or RGB, power up timing, touch screen drive IC parameters, display screen resolution and so on. In the display module detection device, configuration parameters of multiple types of display modules are pre-stored in the storage module 2. The test system module 1 may select suitable configuration parameters from the storage module 2 based on types of the display screen and the touch screen in the detected display module, and then the test system module 1 configures the output parameters of the test signal output interface 11 in accordance with the configuration parameters in the storage module 2 and matches the output parameters of the test signal output interface 11 of the test system module 1 with the type of the detected display module, thereby performing display module detection for the display module of this type. The storage module 2 may communicate with the test system module 1 via a network communication protocol. The storage module 2 may send to the test system module 1 in accordance with the communication protocol communication information corresponding to the configuration parameters concerning the display module under detection. The test system module 1 receives the communication information sent by the storage module 2 and generates output parameters for driving the detected display module by using the received information, so as to match the parameters of the test signal output interface 11 of the test system module 1 with the type of the display module under detection. The output parameters of the test signal output interface 11 of the test system module 1 may comprise parameters related to driving the detected display module, e.g., initialization codes, driving time sequences and power up timing for the display screen and the touch screen in the detected display module and so on.

In the display module detection device, the storage module 2 may input corresponding configuration parameters into the test system module 1 depending on different types of detected display modules, so as to adapt the display module detection device to multiple types of display modules without replacing a kernel of the test system module 1.

Therefore, the display module detection device may detect multiple types of display modules, and a high applicability can be achieved.

Preferably, the test system module 1 may be an embedded module having an ARM processor architecture in combination with a corresponding peripheral circuit design, which has advantages of small volume, low power consumption, low cost and high performances. For example, the test system module 1 may comprise an A9 or A15 architecture processor, and may be debugged on the basis of combining with a peripheral circuit design. Further, a Linux or Android operating system may be installed to form a sophisticated embedded module.

In a preferred embodiment, the storage module 2 may comprise a single-chip microprocessor (SCM) module. The SCM module may comprise a network interface, and the test system module 1 may be provided with a network interface, the network interface of the SCM module may be communicatively connected with that of the test system module 1.

The SCM module may be communicatively connected with the test system module 1 via an Ethernet communication protocol, for example, via a TCP/IP protocol or a UDP protocol.

The above SCM module can be a system having a networking function and an In-Application Programming (IAP) function. The peripheral circuit related thereto may comprise a buffer, a memory, a control button 6, a serial port and the like. The SCM module can achieve replacement of SCM programs by means of the IAP function. Programs for configuration parameters of different types of display modules may be stored in advance in the memory of the SCM module. The programs for configuration parameters of the display modules may be complied by means of a compiler such as keil and GCC in software on a computer device, and then downloaded into the SCM by way of ISP or IAP and so on. When the type of the detected display module is changed or switched, it is only necessary to choose a corresponding program from the SCM module. It is unnecessary to recompile the kernel of the test system module 1 or reinstall an image file of the test system module 1, but instead, what is needed is only to replace a program stored in the storage module 2, which makes the operation simple and convenient. Preferably, in case the SCM module comprises a control button 6, the SCM module may be manipulated and controlled via the control button 6.

As shown in FIG. 1, in a preferred embodiment, the display module detection device further comprises a power module 3, the power module 3 being electrically connected with both the test system module 1 and the SCM module. Thereby, the power module 3 can provide electric power to the display module via the test system module 1. The design of the power module 3 mainly takes into consideration a range of an operating voltage and numbers of voltage levels of the corresponding module as well as power thereof, etc., so as to satisfy power requirements of the display module during the detection by lighting up.

The power module 3 may be an integrated digital power source having multiple output paths of voltage, and the power module may further be a module composed of a plurality of independent drive power sources having a controllable ON/OFF function.

Besides, the power module 3 may further comprise an operation button module for switching an operation mode of the power module 3. The power module 3 may have operation modes adapted to powering on, powering off, lighting up the detected display module, driving the touch screen, program selection and the like.

Based on each of the above embodiments, the test signal output interface 11 comprised in the test system module 1 may comprise a synchronous serial communication bus interface SPI, an inter-integrated circuit (IIC) bus interface, a mobile industry processor interface MIPI, a color mode RGB signal interface, a central processing unit (CPU) interface, a video graphics array (VGA) interface and a power interface, etc.

The test signal output interface 11 of the test system module 1 may comprise two signal connectors. One signal connector may be provided with the synchronous serial communication bus interface SPI, the inter-integrated circuit (IIC) bus interface, the mobile industry processor interface MIPI, and the power interface. The other signal connector may be provided with the synchronous serial communication bus interface SPI, the inter-integrated circuit (IIC) bus interface, the color mode RGB signal interface, the central processing unit (CPU) interface, the video graphics array (VGA) interface and the power interface.

The two signal connectors provided in the test system module 1 may facilitate corresponding connection of the test system module 1 with different types of display modules. When the display module to be detected is connected with the test system module 1, it is only necessary to prepare a pin board and keep pins of the pin board consistent with the connection defined by the detected display module. For replacement of different types of display modules, what is needed is only to replace the pin board, which makes the operation simple and convenient.

As shown in FIG. 1, the display module detection device may further comprise a display unit 4 being in signal connection with the storage module 2. The display unit 4 is mainly used for displaying, e.g., a type of the display screen in the detected display module, a type of the touch screen, a name of the program selected from the storage module 2, setting information, and some image information during the process of lighting up, so as to assist an operator to obtain more intuitionally running information during the detection.

More preferably, as shown in FIG. 1, the display module detection device may further comprise a collecting module 5 for collecting voltage and current information of the power module when the display screen and a backlight of the display module are lighted up, the collecting module 5 being in signal connection with the power module 3 and the storage module 2. Voltage and current information and the like acquired by the collecting module 5 are transmitted to the storage module 2, and then transmitted to the display module 4 after being processed by the storage module 2. Then the voltage information and the current information collected by the collecting module 5 may be displayed on the display module 4.

Apparently, those skilled in the art can make various modifications and variations to the embodiments of the invention without departing from the spirits and scopes of the invention. Thus if these modifications and variations to these embodiments fall within the scopes of the claims of the invention and the equivalent techniques thereof, they are intended to be encompassed in the present invention.

The invention claimed is:

1. A display module detection device, comprising:

a storage module, in which configuration parameters of multiple types of display modules are pre-stored, the storage module is used for outputting configuration parameters corresponding to a display module to be detected, the configuration parameters comprising initialization codes of a display screen and a touch screen in the display module, driving time sequences of MIPI or RGB interfaces, power up timing and display screen resolution;

and a test system module having a test signal output interface, wherein the test system module is communicatively connected with the storage module and provides an output signal at the test signal output interface for driving the display module to be detected in response to receiving the configuration parameters corresponding to the display module to be detected from the storage module such that the output signal matches a type of the display module to be detected, wherein the display module detection device further comprises a power module electrically connected with both the test system module and the storage module, wherein the power module comprises a plurality of independent drive power sources having a controllable ON/OFF function.

2. The display module detection device according to claim 1, wherein the storage module comprises a single-chip microprocessor (SCM) module, the SCM module having a network interface, and the test system module is provided with a network interface, the network interface of the SCM module being communicatively connected with that of the test system module.

3. The display module detection device according to claim 2, wherein the SCM module is communicatively connected with the test system module via an Ethernet communication protocol.

4. The display module detection device according to claim 2, wherein the SCM module comprises a control button.

5. The display module detection device according to claim 1, wherein the test signal output interface comprised in the test system module comprises a synchronous serial communication bus interface, an inter-integrated circuit bus interface, a mobile industry processor interface, a color mode RGB signal interface, a central processing unit interface, a video graphics array interface and a power interface.

6. The display module detection device according to claim 5, wherein the test system module comprises two signal connectors, wherein one signal connector is provided with the synchronous serial communication bus interface, the inter-integrated circuit bus interface, the mobile industry processor interface, and the power interface, and the other signal connector is provided with the synchronous serial communication bus interface, the inter-integrated circuit bus interface, the color mode RGB signal interface, the central processing unit interface, the video graphics array interface and the power interface.

7. The display module detection device according to claim 6, wherein the display module detection device further comprises a display unit, the display unit being in signal connection with the storage module.

8. The display module detection device according to claim 5, wherein the display module detection device further comprises a display unit, the display unit being in signal connection with the storage module.

9. The display module detection device according to claim 1, wherein the display module detection device further comprises a display unit, the display unit being in signal connection with the storage module.

10. The display module detection device according to claim 9, wherein the display module detection device further comprises a collecting module for collecting voltage and current information of the power module when a display screen and a backlight of the display module are lighted up, the collecting module being in signal connection with the power module and the storage module.

* * * * *